United States Patent [19]

Ives et al.

[11] Patent Number: 4,851,788

[45] Date of Patent: Jul. 25, 1989

[54] MODE SUPPRESSORS FOR WHISPERING GALLERY GYROTRON

[75] Inventors: Robert L. Ives, Cupertino; Howard R. Jory; Joseph Feinstein, both of Menlo Park, all of Calif.

[73] Assignee: Varian Associates, Inc., Palo Alto, Calif.

[21] Appl. No.: 200,818

[22] Filed: Jun. 1, 1988

[51] Int. Cl.[4] ..... H01J 25/00

[52] U.S. Cl. ..... 331/91; 333/228; 315/5; 315/5.51

[58] Field of Search ..... 331/86, 91; 333/228; 315/3, 4, 5, 5.38, 5.51

[56] References Cited

U.S. PATENT DOCUMENTS 3,634,790 1/1972 Turteltaub ..... 333/228 X
4,398,121 8/1983 Chodorow et al. ..... 333/228 X

*Primary Examiner*—Eugene R. LaRoche
*Assistant Examiner*—Robert J. Pascal
*Attorney, Agent, or Firm*—Stanley Z. Cole; Peter J. Sgarbossa; Kenneth L. Warsh

[57] ABSTRACT

A gyrotron interaction resonator 29 operating in a $TE_{n1}$ cavity mode has an array of longitudinal slots 32 in the conductive wall 30. The slots 32 are spaced to couple to the unwanted $TE_{n1}$ modes and to other modes of differing n and not to the desired mode. Wave-absorptive material 34 spaced from the inner cavity wall 28 and coupled to slots 32 absorbs the unwanted modes.

10 Claims, 3 Drawing Sheets

MODE SUPPRESSORS FOR WHISPERING GALLERY GYROTRON

FIELD OF THE INVENTION

The invention pertains particularly to gyrotron oscillators operating in a "whispering gallery" resonator mode such as $TE_{n1}$ or $TE_{n2}$ where the standing wave hugs the circumferential wall, with periodic field reversals.

PRIOR ART

Most gyrotrons have had a cylindrical resonant interaction cavity supporting a $TE_{0n}$ mode with electric field lines circular about the cavity axis. These modes have low wall losses, and field maxima far from the wall so that beam interception is minimized. Unfortunately, generating higher power calls for greater beam area, so the resonator becomes larger and supports more unwanted modes.

SUMMARY OF THE INVENTION

A purpose of the invention is to provide a gyrotron oscillator generating increased power.

A further purpose is to provide a gyrotron with suppression of undesirable resonator modes.

These objects are realized by a gyrotron with resonator operating in a "whispering gallery" mode having high electric field near the cavity wall so that a large diameter electron beam may be used.

The name derives from an analogy to an acoustic "whispering gallery" where one person standing near a long concave wall can be heard by another far away near the wall. The edge of the sound wave intercepting the wall is continuously reflected from it so as the wave travels, its intensity concentrates near the wall. The electromagnetic wave analogy is a $TE_{n1}$ wave in a cylindrical cavity. For large n the $TE_{n1}$ standing wave has a pattern with periodic reversals of azimuthal electric field around the circumference. The $TE_n1$ fields fall off as the $(n-1)^{th}$ power of radial distance, toward the cavity center for large value of n.

There are other resonant cavity modes, however, including those with other values of n. Also, each of these, as well as the desired $TE_{n1}$, has a degenerate mode in which the mode pattern is rotated by $\frac{1}{4}$ of the period. According to the invention, the unwanted modes are suppressed by an array of slots in the wall parallel to the axis, placed to lie on zeros of wall currents in the desired mode. The slots couple to lossy material outside the inner wall surface to damp the undesired modes having currents crossing the slots.

DESCRIPTION OF THE PREFERRED EMBODIMENTS

Figure 1:
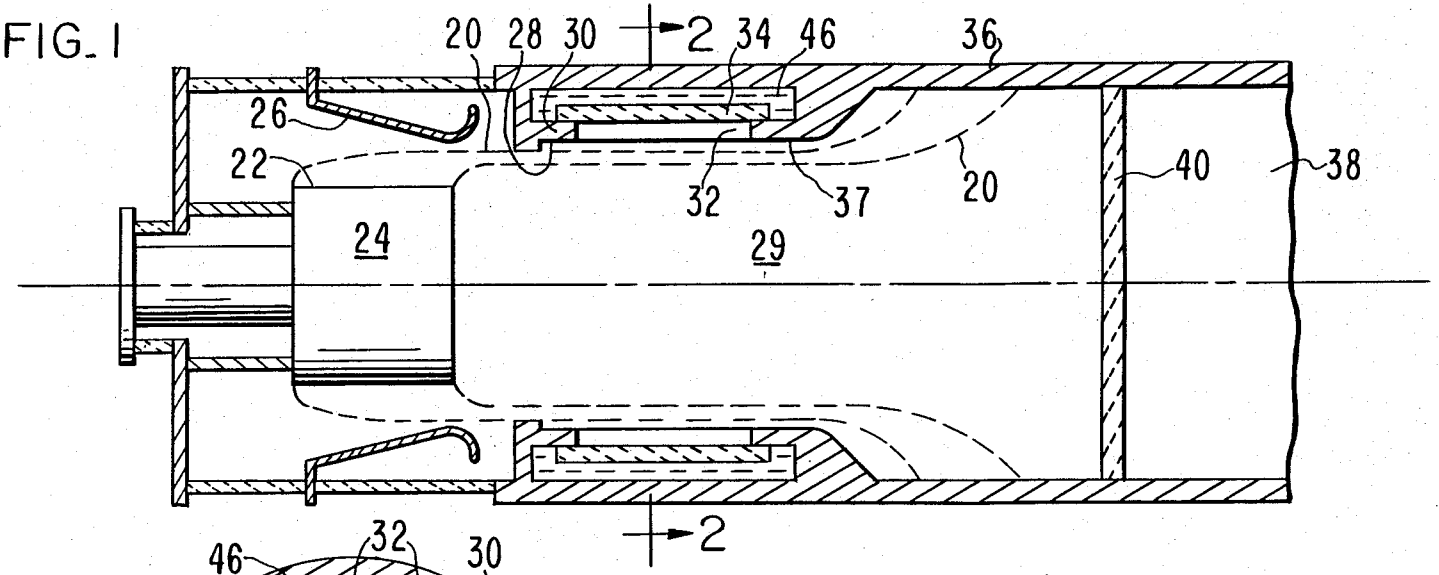
FIG. 1 is a schematic section of a gyrotron embodying the invention.

FIG. 1 illustrates the essence of the invention. A hollow beam of electrons 20 is drawn from the conical or cylindrical emitting surface 22 of a thermionic cathode 24 by the electric field of an accelerating anode 26. Anode 26 is tapered inward downstream to provide an axial electric field component causing the electrons to drift downstream as well as the radial electric field to give the electrons a radial component of velocity. An axial magnetic field deflects the electrons azimuthally so they do not strike anode 26 but emerge as a hollow beam which is further accelerated through a beam tunnel with inner wall that is preferably cut off as a waveguide for the desired mode, through a hollow interaction resonator 29 comprising a hollow metallic cylindrical wall 30 of inner diameter 28 chosen to support a $TE_{n1}$ electromagnetic mode with a high azimuthal mode number n.

Figure 2:
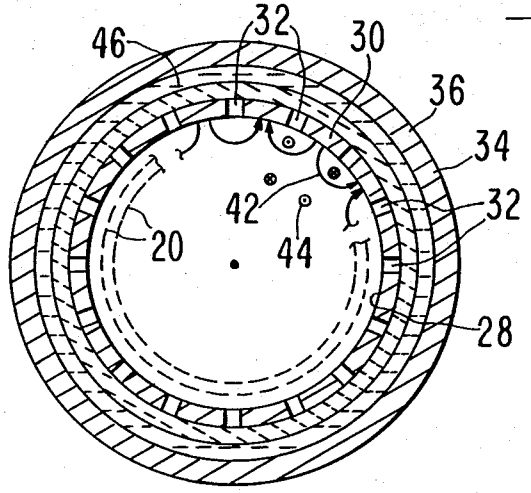
FIG. 2 is a schematic axial section perpendicular to the axis of the resonator of the gyrotron of FIG. 1.

This resonant mode has periodic field reversals around the circumference, as shown in cross-section FIG. 2, and is degenerate in that a second $TE_{n1}$ mode can exist, with the same resonant frequency but with its field pattern rotated $\frac{1}{4}$ period. In a typical smooth-bore gyrotron, both degenerate modes are present. When both are excited with equal amplitudes, they result in a circularly polarized output mode. For single-mode operation it is necessary to suppress any other modes whose frequency is close, such as $TE_{n1}$ modes with nearby azimuthal mode number n. This is done by a periodic array of slots 32 in resonator wall 30, extending axially and spaced by any integral multiple of the distance between field reversals ($\frac{1}{2}$ the complete reversal periodicity). A slot located where the azimuthal circulating current in wall 30 is high will couple strongly to the undesired cavity modes. If the slot is located where the azimuthal wall current of the desired mode is zero it will not couple to the desired resonator field. Outside wall 30 is a cylinder 34 of lossy material such as a beryllia ceramic loaded with carbide particles to absorb the coupled energy from the unwanted modes.

Within wall 30, beam 20 interacts with the transverse electric field in the well-known gyrotron interaction at the cyclotron frequency of the electrons in the axial magnetic field to produce microwave radiation. Downstream of resonator 29 the axial field is reduced, allowing beam 20 to expand and be collected on the inner surface of a collector wall 36 which forms part of the vacuum envelope. The envelope is cooled by circulating liquid (not shown). Wall 36 extends beyond the collection area to form an output waveguide 38 sealed from the vacuum by a dielectric window 40, as of alumina or beryllia ceramic.

FIG. 2 is a section along line 2—2 of FIG. 1 illustrating the patterns of electric 42 and magnetic 44 fields of the degenerate $TE_{n1}$ mode which is suppressed, along with modes of different values and modes of different symmetries. A coolant 46 such as water circulates outside lossy cylinder 34 which is vacuum-sealed to cavity wall 30 outside slots 32. In an alternate embodiment cylinder 34 is a low-loss ceramic and the power is absorbed directly by water 46.

Figure 3:
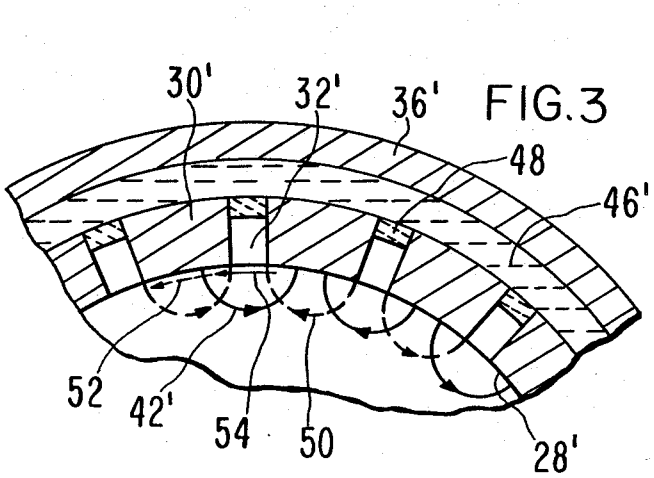
FIG. 3 is a partial section of the resonator of a different embodiment.

FIG. 3 is an expanded view of another embodiment in which lossy cylinder 34 is replaced by pieces of lossy material 48 located directly in slots 32' but removed from cavity-facing surface 28' to a point where fringing fields of the desired mode have decayed to a point where power loss from this mode is negligible. The fringing electric field of the desired mode in slots 32 is radial, so, a waveguides, slots 32 are far beyond cutoff and the fields decay rapidly (exponentially) with radial distance. For the suppressed modes, including the degenerate mode shown in FIG. 2, the rf electric field is across the entrances to at least some of the slots 32 so azimuthal wall currents flow across the entrances. The TE mode excited in slots 32 is not cut off as a waveguide mode, but propagates through slots 32 without much attenuation until it enters lossy material 48. For maximum attenuation, the depth of slots 32, as capacitively end-loaded by dielectric 48, should be an integral number of electrical half-wavelengths of an undesired mode to provide maximum resistive impedance at their inner ends on the resonator surface 28.

In FIG. 3 the desired mode's electric field is shown as dotted lines 50 and the suppressed degenerate orthogonal mode as solid lines 42'. Suppression of the degenerate $TE_{n1}$ mode is not essential for good gyrotron operation in tubes where the output power is coupled from both polarizations may result in a slight loss of efficiency. The azimuthal wall currents 52 of desired mode 50 are zero at slots 32' and maximum on the cavity surface 28' between slots. For suppressed mode 42' the wall currents 54 are maximum across slots 32'. For undesired modes of different n index there will be high current and thus suppression in some of the slots 32'. It is these close undesired modes that are the most serious problem for whispering gallery gyrotrons. It is necessary to suppress these in order to achieve high efficiency.

Figure 4:
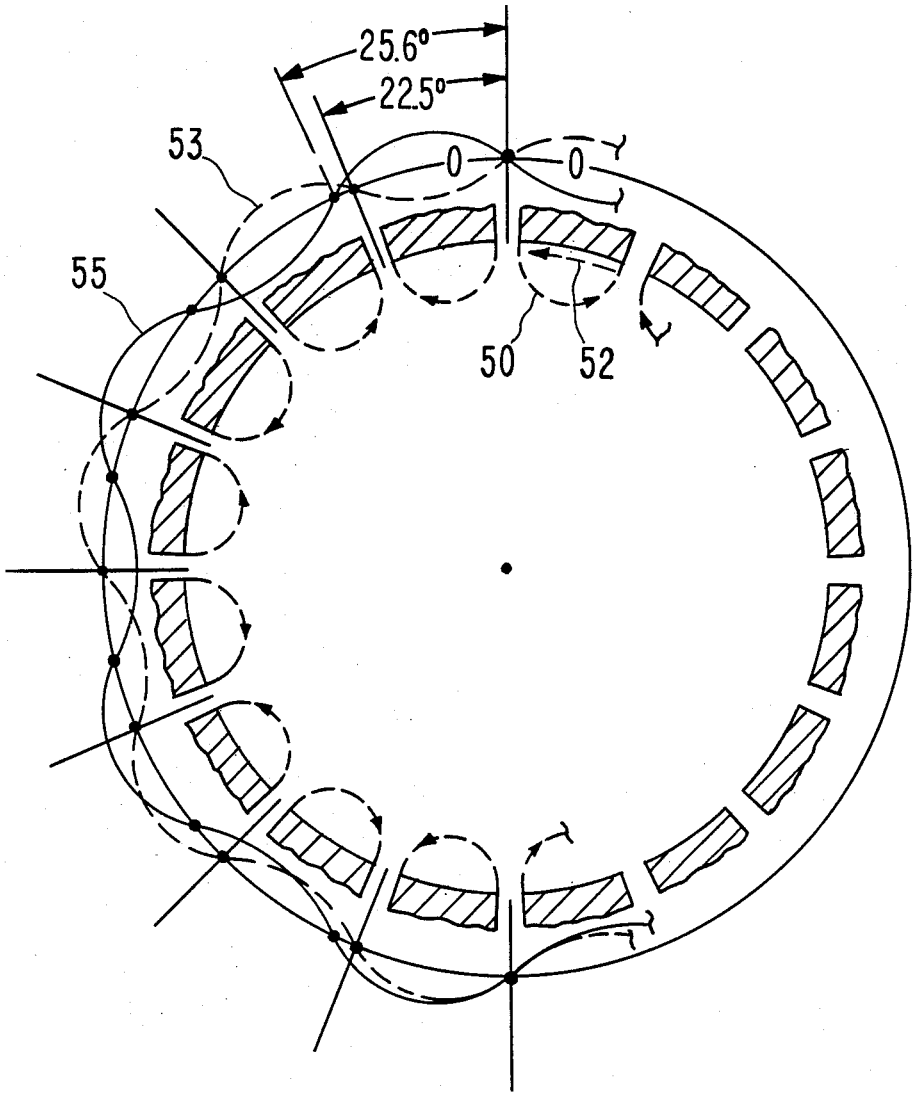
FIG. 4 is a sketch of patterns of other modes.

FIG. 4 is a schematic mode diagram illustrating the electric field 50 of the desired mode. Outside is a radial graph of the amplitudes of the slot currents 53 of this desired $TE_{8,1}$ mode and 55 of the undesired $TE_{7,1}$ mode having a close resonant frequency. Both slot currents are zero at the top and bottom of the graph, but 90 degrees away the $TE_{7,1}$ has maximum slot coupling. A similar pattern applies to the degenerate $TE_{7,1}$ mode and $TE_{9,1}$ modes.

Figure 5:
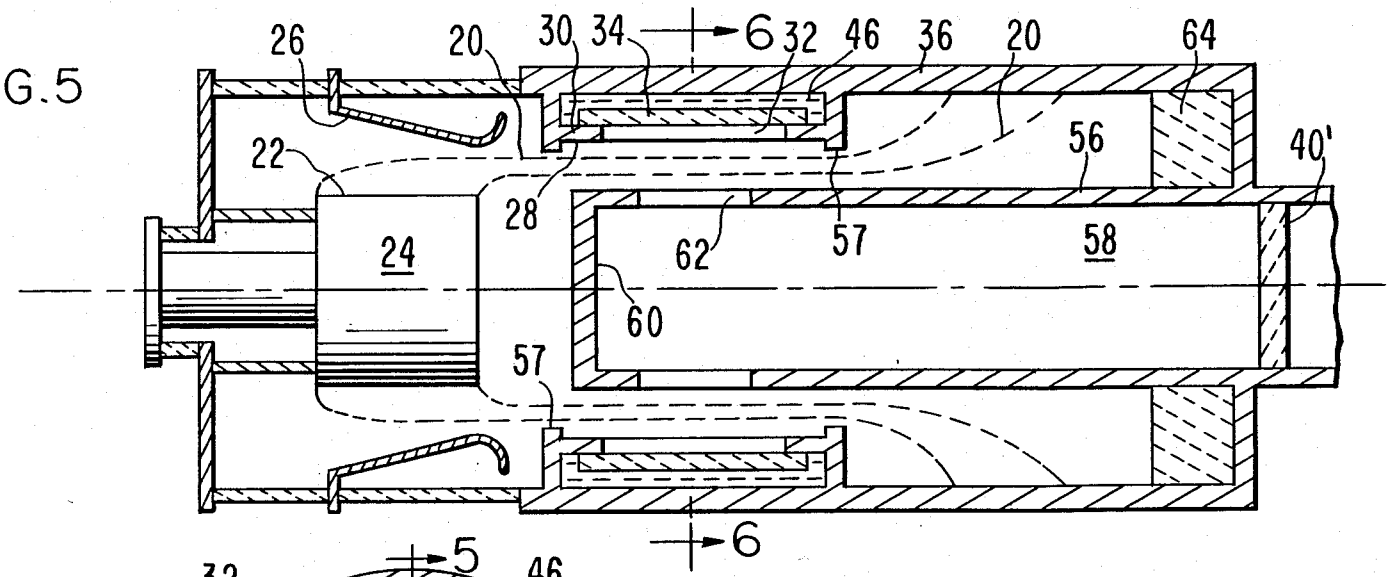
FIG. 5 is an axial section of an embodiment with low-order waveguide output.
Figure 6:
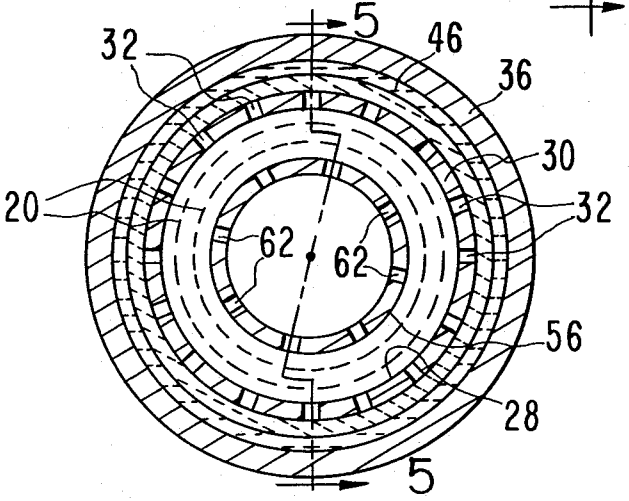

FIG. 5 is an axial section of an alternative embodiment of the invention. In the embodiment of FIG. 1, the output waveguide 38 transmits the power in the $TE_{n1}$ mode generated in the resonator 28. This high-order mode is suitable for applications such as plasma heating where direct absorption is desired. However, for transmission through a waveguide system, exciting an antenna etc., a low-order mode is often needed. The embodiment of FIG. 5 shows an integral converter to a wavegiide mode with circular electric field such as $TE_{01}$. This mode is customary in conventional gyrotrons, and in the output waveguide of inverted coaxial magnetrons. Inside hollow electron beam 20, a hollow output waveguide pipe 56 extends through collector 36 to form a central conductor in resonator 30. Because the interaction $TE_{n1}$ mode is concentrated near the inner surface 28 of resonator 30, this mode is not perturbed unduly by waveguide 56 which is smaller than cavity 30. The ends of resonator 30 are constricted by irises 57 to minimize leakage of interaction fields into the cathode and collector regions. An auxiliary lossy load 64 at the output end of collector 36 may be used to absorb the now-unwanted leakage power.

At the end of output waveguide 56 within resonator 30 is an array of slots 62 with angular spacing $1/n^{th}$ of the circumference, which would typically be twice the angular spacing of interaction slots 32. Slots 62 are aligned midway between alternating slots 32 so that the coupling is mainly from the desired $TE_{n1}$ cavity mode and is from fields with the same azimuthal direction. Waveguide 56 is thereby excited in one of the circular symmetric $TE_{0n}$ modes such as $TE_{01}$ which is thus uniquely and circularly symmetrically generated. By increasing its wall thickness and hence the depth of slots 62 the outer diameter of waveguide 56 is made large enough to provide adequate output coupling from the $TE_{n1}$ mode of the interaction cavity without distorting its mode pattern. Output power is transmitted through a circular dielectric window 40'.

Of course, many other methods of conversion to a lower-order mode are possible. In the conventional gyrotron the $TE_{0n}$ mode is usually transmitted through the end of the collector, analogous to FIG. 1. With the described embodiment of FIG. 5 the problems of separating the microwaves from the spent beam and providing adequate collector size are avoided.

The above preferred embodiments are illustrative and not to be limiting. The invention is to be limited only by the following claims and their legal equivalents.

We claim:

1. An electron tube for generating electromagnetic wave energy comprising:

means for generating a stream of electrons progressing in a longitudinal direction;

means for generating a steady magnetic field having a component in said longitudinal direction for directing said stream;

an electromagnetic resonator comprising a conductive wall surrounding said stream, said resonator adapted to support an electromagnetic wave in energy-exchanging relation with said stream, said wave being in a desired mode having electric field lines transverse to said longitudinal direction and terminating on the inner surfaces of said resonator, with periodic reversals of said electric field lines around said wall;

an array of slots in said wall elongated in said longitudinal direction, said slots being periodically spaced in the direction perpendicular to said longitudinal direction at positions where currents of said mode in said inner surface of said wall are minimum and;

lossy material spaced from said inner surface of said wall in the direction from said stream in energy-absorbing relation with the fields in said slots.

2. The tube of claim 1 wherein said slots are disposed to interrupt wall currents of at least one undesired mode.

3. The tube of claim 1 wherein said lossy material is in said slots.

4. The tube of claim 1 wherein said slots extend through said wall and said lossy material is outside said wall.

5. The tube of claim 4 wherein said wall is approximately an integral number of electrical half-wavelengths thick at the frequency of an undesired mode of resonance.

6. The tube of claim 1 wherein some of said slots extend into said wall as waveguides, to a depth to be resonant at the frequency of an undesired mode of said resonator.

7. The tube of claim 6 wherein said inner surface of said wall is a right circular cylinder with its axis in said longitudinal direction.

8. The tube of claim 7 wherein said mode is a $TE_{n1}$ mode.

9. The tube of claim 8 wherein said desired undersired mode is another $TE_{n1}$ mode.

10. The tube of claim 8 further comprising a waveguide extending coaxially within said resonator with slots coupling to alternate peaks of electric field of said desired mode, said waveguide adapted to transmit a $TE_{o,m}$ mode, where m is smaller than n.

* * * * *